US008944571B2

(12) United States Patent
Horiguchi et al.

(10) Patent No.: US 8,944,571 B2
(45) Date of Patent: Feb. 3, 2015

(54) LIQUID JET HEAD, LIQUID JET APPARATUS AND METHOD OF MANUFACTURING LIQUID JET HEAD

(71) Applicant: SII Printek Inc., Chiba (JP)

(72) Inventors: Satoshi Horiguchi, Chiba (JP); Yuzuru Kubota, Chiba (JP); Yoshinori Domae, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 14/075,024

(22) Filed: Nov. 8, 2013

(65) Prior Publication Data

US 2014/0139593 A1 May 22, 2014

(30) Foreign Application Priority Data

Nov. 22, 2012 (JP) ..... 2012-256562

(51) Int. Cl.
*B41J 2/045* (2006.01)
*B41J 2/16* (2006.01)

(52) U.S. Cl.
CPC ..... *B41J 2/1626* (2013.01); *B41J 2/1609* (2013.01); *B41J 2/1623* (2013.01); *B41J 2/1631* (2013.01); *B41J 2/1632* (2013.01)
USPC ..... 347/68

(58) Field of Classification Search
CPC .... B41J 2/14209; B41J 2/1609; B41J 2/1623; B41J 2/14201; B41J 2/1621
USPC ..... 347/68–72; 29/890.1, 25.35
See application file for complete search history.

(56) References Cited

U.S. PATENT DOCUMENTS

| | | | | |
|---|---|---|---|---|
| 5,625,393 | A | 4/1997 | Asai | 347/69 |
| 8,651,631 | B2 * | 2/2014 | Koseki | 347/71 |
| 2003/0193550 | A1 | 10/2003 | Harajiri et al. | 347/68 |

FOREIGN PATENT DOCUMENTS

| | | |
|---|---|---|
| JP | 2004314312 | 11/2004 |
| JP | 2007152624 | 6/2007 |
| JP | 2011104791 | 6/2011 |
| WO | 2012144597 | 10/2012 |

OTHER PUBLICATIONS

IPO Search Report mailed May 21, 2014 issued in GB Appln. No. GB1320516.6.

* cited by examiner

*Primary Examiner* — An Do
(74) *Attorney, Agent, or Firm* — Adams & Wilks

(57) ABSTRACT

A liquid jet head is provided with an actuator substrate partitioned by elongated walls of a piezoelectric body and having elongated ejection grooves and elongated non-ejection grooves alternately arrayed thereon so as to penetrate the actuator substrate from an upper surface through a lower surface thereof; a cover plate provided on the upper surface and having first slits communicating with the ejection grooves on one side and second slits communicating with the ejection grooves on the other side; and a nozzle plate provided on the lower surface and having nozzles communicating with the ejection grooves. The non-ejection grooves extend, on the other side, up to a second-side peripheral end of the actuator substrate, and the actuator substrate is left to form raised bottom portions on bottoms of the non-ejection grooves near the second-side peripheral end.

12 Claims, 9 Drawing Sheets

LIQUID JET HEAD, LIQUID JET APPARATUS AND METHOD OF MANUFACTURING LIQUID JET HEAD

BACKGROUND

1. Technical Field

The present invention relates to a liquid jet head that ejects liquid droplets onto a recording medium to perform recording, a liquid jet apparatus, and a method of manufacturing the liquid jet head.

2. Related Art

Recently, there has been used a liquid jet head of an ink jet system that ejects ink droplets onto a recording paper or the like to record characters or figures thereon, or ejects a liquid material onto the surface of an element substrate to form a functional thin film thereon. In the ink jet system, liquid such as ink or a liquid material is guided from a liquid tank into a channel through a supply path, and pressure is applied to liquid filled in the channel to thereby eject the liquid from a nozzle that communicates with the channel. When ejecting liquid, characters or figures are recorded, or a functional thin film having a predetermined shape is formed by moving the liquid jet head and a recording medium.

FIGS. 13A and 13B are cross-sectional schematic views of a liquid jet head 101 described in JP 2011-104791 A. FIG. 13A is a cross-sectional schematic view of a deep groove 105*a* for generating a pressure wave in liquid in the longitudinal direction thereof. FIG. 13B is a cross-sectional schematic view in a direction perpendicular to the longitudinal direction of grooves 105. The liquid jet head 101 has a laminate structure including a piezoelectric plate 104 of a piezoelectric body, a cover plate 108 which is adhered to one surface (upper surface) of the piezoelectric plate 104, a flow path member 111 which is adhered to an upper surface of the cover plate 108, and a nozzle plate 102 which is adhered to the other surface (lower surface) of the piezoelectric plate 104. Deep grooves 105*a* and shallow grooves 105*b* constituting the grooves 105 are alternately formed in parallel on the piezoelectric plate 104. Each of the deep grooves 105*a* penetrates the piezoelectric plate 104 from the upper surface through the lower surface thereof. Each of the shallow grooves 105*b* is opened on the upper surface of the piezoelectric plate 104, and the piezoelectric material is left on the lower surface thereof at positions corresponding to the positions of the shallow grooves 105*b*. Side walls 106*a* to 106*c* are formed between the deep grooves 105*a* and the shallow grooves 105*b*. Drive electrodes 116*a* and 116*c* are formed on side surfaces of the respective deep grooves 105*a*. Drive electrodes 116*b* and 116*d* are formed on side surfaces of the respective shallow grooves 105*b*.

Liquid supply ports 109 and liquid discharge ports 110 are formed in the cover plate 108. Each of the liquid supply ports 109 communicates with one end of each of the deep grooves 105*a*, and each of the liquid discharge ports 110 communicates with the other end of each of the deep grooves 105*a*. A liquid supply chamber 112 and a liquid discharge chamber 113 are formed in the flow path member 111. The liquid supply chamber 112 communicates with the liquid supply ports 109, and the liquid discharge chamber 113 communicates with the liquid discharge ports 110. Nozzles 103 are formed in the nozzle plate 102, and communicate with the respective deep grooves 105*a*.

The liquid jet head 101 is driven in the following manner. Liquid supplied through a supply joint 114 which is disposed on the flow path member 111 passes through the liquid supply chamber 112 and the liquid supply port 109, and is then filled into the deep groove 105*a*. The liquid filled into the deep groove 105*a* further passes through the liquid discharge port 110 and the liquid discharge chamber 113, and is then discharged to the outside through a discharge joint 115. When a potential difference is applied between the drive electrodes 116*c* and 116*b*, and between the drive electrodes 116*c* and 116*d*, thickness-shear deformation of the side walls 106*b* and 106*c* is caused. As a result, a pressure wave is generated in the deep groove 105*a*, and liquid droplets are thereby ejected from the nozzle 103.

SUMMARY

In the liquid jet head 101 described in JP 2011-104791 A, the deep grooves 105*a* for liquid droplet ejection and the shallow grooves 105*b* not for liquid droplet ejection are alternately formed. The shallow grooves 105*b* are not opened on the lower surface of the piezoelectric plate 104 toward the nozzle plate 102. On the other hand, the deep grooves 105*a* are opened on the lower surface of the piezoelectric plate 104 toward the nozzle plate 102. The deep grooves 105*a* and the shallow grooves 105*b* are formed by using a dicing blade having a disk with abrasive grains of, for example, diamond embedded on the periphery thereof (also called a "diamond cutter"). Therefore, the outer shape of the dicing blade is transferred to both ends of each of the grooves 105. Generally, a dicing blade having a diameter of two inches or larger is used. For example, when the depth of the deep grooves 105*a* is 360 μm, and the depth of the shallow grooves 105*b* is 320 μm so as to leave a part of the piezoelectric plate 104 of 40 μm on the bottom of each of the shallow grooves 105*b*, circular arc shapes of about 8 mm in total are formed on both ends of each of the shallow grooves 105*b* in the longitudinal direction thereof. The circular arc shapes on the both ends of the shallow groove 105*b* are unnecessary areas. If the length of such areas can be reduced, it is possible to form the liquid jet head 101 in a compact size, and also increase the number of piezoelectric plates 104 that can be taken from a single piezoelectric wafer. Therefore, when the shallow grooves 105*b* are made to penetrate the piezoelectric plate 104 in the same manner as the deep grooves 105*a* without leaving a part of the piezoelectric plate 104 on the bottoms of the shallow grooves 105*b*, the grooves 105 can be formed to have a shorter length in the longitudinal direction thereof. As a result, it is possible to downsize the liquid jet head 101, and increase the number of piezoelectric plates 104 that can be taken from a single piezoelectric wafer.

FIG. 14 is a fragmentary perspective view of the piezoelectric plate 104 of the liquid jet head 101. FIG. 14 is a view illustrating a state where the shallow grooves 105*b* also penetrate the piezoelectric plate 104 from the upper surface through the lower surface thereof in the same manner as the deep grooves 105*a*, and a conductive material 120 is accumulated on the upper surface of the piezoelectric plate 104 and side surfaces of the respective side walls 106 by oblique deposition. The conductive material 120 is accumulated on the upper surface of the piezoelectric plate 104 and both side surfaces of the respective side walls 106 up to approximately half the depth of the grooves 105*a* and 105*b*. A part of the conductive material 120 that is accumulated on the upper surface of the piezoelectric plate 104 can be patterned by lift-off, or photolithography and etching. The conductive material 120 is also accumulated on the upper half part of each of inclined surfaces 121 onto which the outer shape of the dicing blade is transferred. The drive electrodes 116*c* formed on the both side surfaces of the deep groove 105*a* may be electrically connected to each other. However, it is necessary to electrically separate the drive electrodes 116*b* formed on the both side surfaces of the shallow groove 105*b* from each other, and also the drive electrodes 116*d* from each other.

The part of the conductive material 120 accumulated on the upper surface of the piezoelectric plate 104 is patterned by lift-off or the like. However, a part of the conductive material 120 that is accumulated on the inclined surfaces 121 is difficult to pattern by lift-off, or photolithography and etching, and is therefore removed using laser beams or a dicing blade that is thinner than the width of the grooves 105. However, in this case, since all shallow grooves 105*b* should be scanned one by one with laser beams or the dicing blade to remove the conductive material 120, it takes time for patterning electrodes, and the mass productivity is therefore low.

The present invention has been made in view of the above problems, and is directed to providing a liquid jet head, which is easy to manufacture and the entire size of which is reduced by allowing grooves to penetrate a piezoelectric plate from one surface through the other surface thereof to thereby reduce the length of each groove at an end thereof.

A liquid jet head according to an embodiment of the present invention includes an actuator substrate that is partitioned by elongated walls of a piezoelectric body, and has elongated ejection grooves and elongated non-ejection grooves alternately arrayed thereon so as to penetrate the actuator substrate from an upper surface through a lower surface thereof. The non-ejection grooves extend from the vicinity of a first-side peripheral end of the actuator substrate positioned at a first side of the liquid jet head up to a second-side peripheral end thereof positioned at a second side of the liquid jet head, and the actuator substrate is left to form raised bottom portions on bottoms of the non-ejection grooves near the second-side peripheral end of the actuator substrate.

Common electrodes are formed in strip form on side surfaces of the walls, the side surfaces facing the ejection grooves, along a longitudinal direction of the walls, and active electrodes are formed in strip form on side surfaces of the walls, the side surfaces facing the non-ejection grooves, along the longitudinal direction of the walls. The active electrodes are arranged above upper surfaces of the raised bottom portions.

Each of the active electrodes is formed from a position in the vicinity of a first end of each of the non-ejection grooves, the first end being positioned at the first side, up to the second-side peripheral end of the actuator substrate.

Each of the non-ejection grooves includes, on the first end thereof, an inclined surface which is inclined outward from a lower surface opening opened on a lower surface of the non-ejection groove toward an upper surface opening opened on an upper surface thereof. Further, an end of each of the active electrodes, the end being positioned at the first side, is located closer to the second side from a point on the inclined surface at the same depth as a lower end of the active electrode.

The liquid jet head further includes a cover plate that is provided on the upper surface of the actuator substrate, and has first slits communicating with the ejection grooves on the first side and second slits communicating with the ejection grooves on the second side, and a nozzle plate that is provided on the lower surface of the actuator substrate, and has nozzles communicating with the ejection grooves.

Each of the common electrodes is arranged in each of the ejection grooves from a position at which each of the first slits is opened up to an end thereof positioned at the second side.

The upper surfaces of the raised bottom portions are located at positions deeper than approximately half the depth of the ejection grooves.

A material of the nozzle plate has a lower stiffness than a material of the cover plate.

A liquid jet apparatus according to an embodiment of the present invention includes the liquid jet head described above; a movement mechanism configured to relatively move the liquid jet head and a recording medium; a liquid supply tube configured to supply liquid to the liquid jet head; and a liquid tank configured to supply the liquid to the liquid supply tube.

A method of manufacturing a liquid jet head according to an embodiment of the present invention includes a groove formation step of forming ejection grooves and non-ejection grooves on a piezoelectric substrate so as to be alternately arrayed in parallel, wherein an end of each of the non-ejection grooves, the end being positioned at one side of the piezoelectric substrate, is ground shallowly to form a raised bottom portion; a mask provision step of providing a mask so as to cover an end of each of the ejection grooves, the end being positioned at the other side of the piezoelectric substrate, and an end of each of the non-ejection grooves, the end being positioned at the other side of the piezoelectric substrate; a conductive body accumulation step of accumulating a conductive body on the piezoelectric substrate by oblique deposition; an electrode formation step of forming electrodes by patterning the conductive body; a cover plate provision step of providing a cover plate on an upper side of the piezoelectric substrate; and a nozzle plate provision step of providing a nozzle pate on a lower side of the piezoelectric substrate.

The method further includes, after the groove formation step, a piezoelectric substrate grinding step of grinding a lower surface of the piezoelectric substrate, the lower surface being opposite to an upper surface on which the ejection grooves and the non-ejection grooves are formed, to allow the non-ejection grooves to penetrate the piezoelectric substrate from the upper surface through the lower surface thereof.

The nozzle plate provision step includes providing the nozzle plate on the lower surface of the piezoelectric substrate.

The liquid jet head according to an embodiment of the present invention includes an actuator substrate that is partitioned by elongated walls of a piezoelectric body, and has elongated ejection grooves and elongated non-ejection grooves alternately arrayed thereon so as to penetrate the actuator substrate from an upper surface through a lower surface thereof. The non-ejection grooves extend from the vicinity of a first-side peripheral end of the actuator substrate positioned at a first side of the liquid jet head up to a second-side peripheral end thereof positioned at a second side of the liquid jet head, and the actuator substrate is left to form raised bottom portions on bottoms of the non-ejection grooves near the second-side peripheral end of the actuator substrate. Accordingly, it is possible to provide a liquid jet head that can be formed in a compact size by reducing the length of the actuator substrate in the longitudinal direction of the ejection grooves, and can be manufactured with high yield by improving the processing strength in the back surface of the actuator substrate.

DETAILED DESCRIPTION (First Embodiment)

Figure 1:
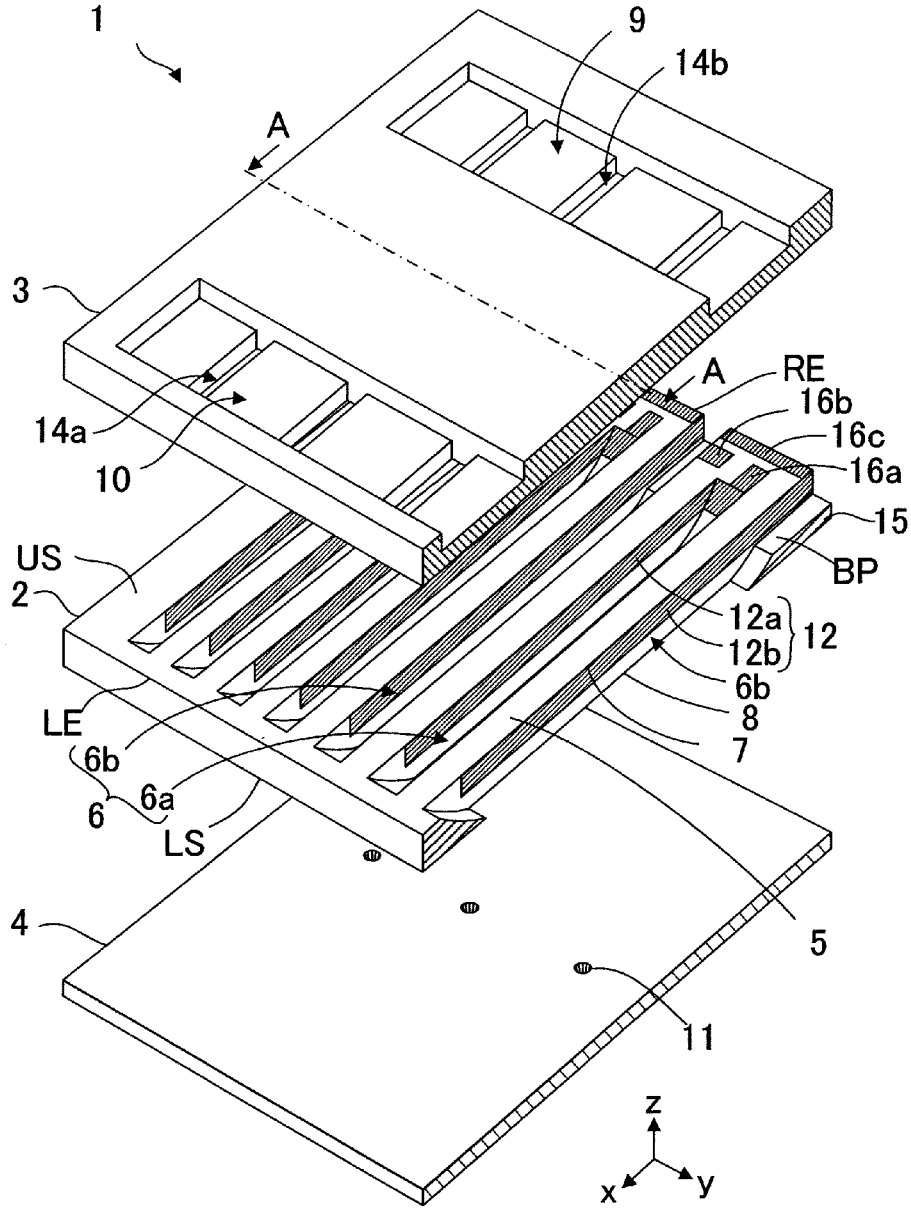
FIG. 1 is an exploded perspective view of a liquid jet head according to a first embodiment of the present invention.
Figure 2A:
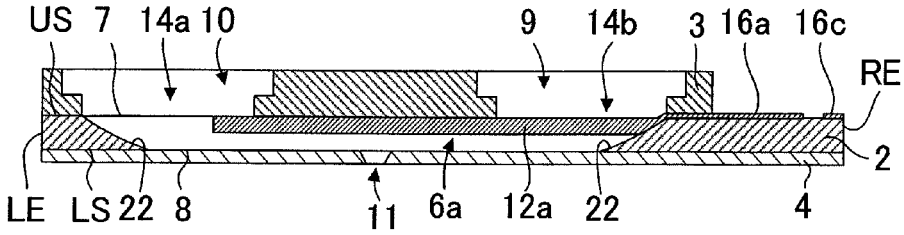
FIGS. 2A to 2C are cross-sectional schematic views of the liquid jet head according to the first embodiment of the present invention.
Figure 2B:
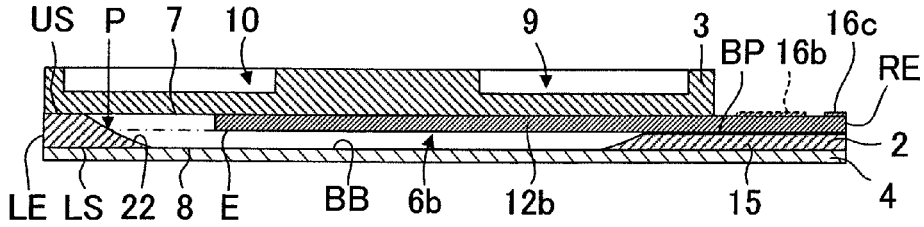
Figure 2C:
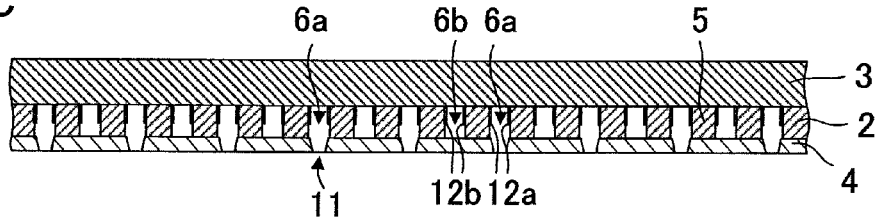

FIGS. 1 to 2C are explanatory drawings of a liquid jet head 1 according to the first embodiment of the present invention. FIG. 1 is an exploded perspective view of the liquid jet head 1. FIG. 2A is a cross-sectional schematic view of an ejection groove 6*a* along the longitudinal direction thereof. FIG. 2B is a cross-sectional schematic view of a non-ejection groove 6*b* along the longitudinal direction thereof. FIG. 2C is a cross-sectional schematic view taken along line A-A shown in FIG. 1.

As shown in FIGS. 1 to 2C, the liquid jet head 1 is provided with an actuator substrate 2, a cover plate 3 provided on the upper side of the actuator substrate 2, and a nozzle plate 4 provided on the lower side of the actuator substrate 2. Elongated ejection grooves 6*a* and elongated non-ejection grooves 6*b*, each of which penetrates the actuator substrate 2 from an upper surface US through a lower surface LS thereof, are alternately arrayed and partitioned by elongated walls 5 of a piezoelectric body in the actuator substrate 2. The cover plate 3 is provided on the upper surface US of the actuator substrate 2 so as to cover a part of each of upper surface openings 7 of the ejection grooves 6*a* and each of upper surface openings 7 of the non-ejection grooves 6*b*, and has first slits 14*a* which communicate with the respective ejection grooves 6*a* on one side thereof (hereinbelow, referred to as a first side) and second slits 14*b* which communicate with the respective ejection grooves 6*a* on the other side thereof (hereinbelow, referred to as a second side). In the following description, each of "the first side" and "the second side" referred to in respective components indicates the same side in all of the components. The nozzle plate 4 is provided with nozzles 11 which communicate with the respective ejection grooves 6*a*, and provided on the lower surface LS of the actuator substrate 2 so as to cover lower surface openings 8 of the ejection grooves 6*a* and the non-ejection grooves 6*b*.

Common electrodes 12*a* are formed in strip form on side surfaces, the side surfaces facing the ejection grooves 6*a*, of the walls 5 along the longitudinal direction thereof. Active electrodes 12*b* are formed in strip form on side surfaces, the side surfaces facing the non-ejection grooves 6*b*, of the walls 5 along the longitudinal direction thereof. In each of the non-ejection grooves 6*b*, an end positioned at the second side (second end) extends up to a peripheral end RE of the actuator substrate 2 positioned at the second side (hereinbelow, referred to as a second-side peripheral end RE). Near the second-side peripheral end RE of the actuator substrate 2, raised bottom portions 15, each of which is the remainder of the actuator substrate 2, are formed on the bottoms of the non-ejection grooves 6*b* on the second end thereof. The active electrodes 12*b* are provided above upper surfaces BP of the raised bottom portions 15.

Hereinbelow, a more detailed description will be made. The grooves 6 formed in the actuator substrate 2 include the ejection grooves 6*a* and the non-ejection grooves 6*b*. The ejection grooves 6*a* and the non-ejection grooves 6*b* are alternately arrayed in parallel in a direction (y direction) perpendicular to the longitudinal direction (x direction) of the grooves 6. Each of the ejection grooves 6*a* has inclined surfaces 22 on respective ends at the first side (first end) and the second side (second end) in the longitudinal direction thereof. Each of the inclined surfaces 22 is inclined outward from the lower surface opening 8 toward the upper surface opening 7, that is, from the lower surface LS toward the upper surface US of the actuator substrate 2. Each of the ejection grooves 6*a* is formed from a position in the vicinity of a peripheral end LE of the actuator substrate 2 positioned at the first side (hereinbelow, referred to as a first-side peripheral end LE) up to a position in the vicinity of the second-side peripheral end RE thereof as well as in the vicinity of an end of the cover plate 3. Each of the non-ejection grooves 6*b* has an inclined surface 22 at an end in the longitudinal direction thereof positioned at the first side (first end). This inclined surface 22 is inclined outward from the lower surface opening 8 (bottom surface BB) toward the upper surface opening 7 thereof. The second end of each of the non-ejection grooves 6*b* extends up to the second-side peripheral end RE of the actuator substrate 2. Near the second-side peripheral end RE of the actuator substrate 2, the raised bottom portions 15, each of which is the remainder of the actuator substrate 2, are formed on the bottoms of the non-ejection grooves 6*b* on the second end thereof. One end of each of the raised bottom portions 15 is inclined from the lower surface LS of the actuator substrate 2 toward the upper surface BP of the raised bottom portion 15 in the same manner as the second end of each of the ejection grooves 6*a*. The raised bottom portions 15 can be formed so that the upper surfaces BP thereof are positioned below approximately half the depth of the ejection grooves 6*a*.

In the present invention, when forming the respective grooves 6, it is possible to grind the actuator substrate 2 up to a depth deeper than the final depth of the grooves 6 using a dicing blade. Therefore, it is possible to reduce the length of each of the inclined surfaces 22 in the longitudinal direction thereof to form the actuator substrate 2 in a compact size. Further, by forming the raised bottom portions 15, it is possible to improve the strength in an end part of the actuator substrate 2 on the second side. More specifically, the lower surface openings 8 of the actuator substrate 2 are formed by deeply forming grooves in the actuator substrate 2 so as to penetrate the actuator substrate 2 from the upper surface US through the lower surface LS thereof. Alternatively, the lower surface openings 8 are opened by deeply forming grooves in the actuator substrate 2, and then grinding the lower surface LS of the actuator substrate. If the non-ejection grooves 6*b* do not have the raised bottom portions 15 formed thereon, and are formed flat up to the second-side peripheral end RE, the actuator substrate 2 has a comb shape in which a plurality of comb teeth, composed of the walls 5 which sandwich the respective ejection grooves 6*a* therebetween, is aligned in an arraying direction of the grooves 6. When the comb-shaped actuator substrate 2 is ground from the lower surface LS, problems such as breaking and chipping of tips of the comb tooth occur. Therefore, it becomes difficult to manufacture the liquid jet head 1. On the other hand, when the raised bottom portions 15 are formed on the second ends of the respective non-ejection grooves 6*b*, the material of the actuator substrate 2 is continuously left on the lower surface LS near the second-side peripheral end RE. Therefore, the strength against the breaking or chipping at the time of grinding is improved.

The drive electrodes 12 include common electrodes 12*a* formed on the side surfaces of the ejection grooves 6*a* and active electrodes 12*b* formed on the side surfaces of the non-ejection grooves 6*b*. The common electrodes 12*a* are formed in strip form on side surfaces, the side surfaces facing the ejection grooves 6*a*, of the walls 5 along the longitudinal direction thereof, and electrically connected to each other. Each of the common electrodes 12*a* is arranged from a position at which each of the first slits 14*a* is opened in each of the ejection grooves 6*a* up to the second end thereof. The active electrodes 12*b* are formed in strip form on side surfaces, the side surfaces facing the non-ejection grooves 6*b*, of the walls 5 along the longitudinal direction thereof. Each of the active electrodes 12*b* is arranged from a position in the vicinity of the first end of each of the non-ejection grooves 6*b* up to the second-side peripheral end RE of the actuator substrate 2. As shown in FIG. 2B, an end of each of the active electrodes 12*b* positioned at the first side (first end) is located closer to the second side from a point P on the inclined surface 22 at the same depth as a lower end E of the active electrode 12*b*. For example, when the lower end E of each of the active electrodes 12*b* is positioned at approximately half the depth of the bottom surface BB of the non-ejection groove 6*b*, the first end of the active electrode 12*b* is positioned closer to the second side from the point P on the inclined surface 22 at approximately half the depth between the upper surface US of the actuator substrate 2 and the bottom surface BB.

The common electrodes 12*a* and the active electrodes 12*b* are separated from the nozzle plate 4 constituting the bottom surfaces BB of the ejection grooves 6*a* and the non-ejection grooves 6*b*. Specifically, at least the lower ends E of the active electrodes 12*b* are positioned at a depth not to reach the upper surfaces BP of the raised bottom portions 15. On the upper surface US of the actuator substrate 2, there are arranged, near the second-side peripheral end RE, common terminals 16*a* which are electrically connected to the respective common electrodes 12*a*, active terminals 16*b* which are electrically connected to the respective active electrodes 12*b*, and wirings 16*c* each of which electrically connects the active terminal 16*b* and the active electrode 12*b* that is formed on an adjacent non-ejection grooves 6*b*. The common terminals 16*a* and the active terminals 16*b* are lands connected to a wiring electrode on a flexible substrate (not shown). Each of the active terminals 16*b* is electrically connected to an active electrode 12*b* that is formed on the side surface of one of two walls 5 that sandwich an ejection groove 6*a* therebetween, the side surface facing a non-ejection groove 6*b*. Further, the active terminal 16*b* is electrically connected to an active electrode 12*b* that is formed on the side surface of the other one of the two walls 5, the side surface facing a non-ejection groove 6*b*, via the wiring 16*c* formed along the second-side peripheral end RE.

In this manner, since the ejection grooves 6*a* are formed from the positions at which the first slits 14*a* are opened, it is possible to efficiently generate pressure waves in liquid inside the ejection grooves 6*a*. Further, the active electrodes 12*b* formed on the both side surfaces of each of the non-ejection grooves 6*b* are arranged in the vicinity of the first end of the non-ejection groove 6*b* up to the second-side peripheral end RE of the actuator substrate 2. More specifically, the first end of each of the active electrodes 12*b* is arranged closer to the second side from the point on the inclined surface 22 at the same depth as the lower end E of the active electrode 12*b* in the longitudinal direction of the non-ejection groove 6*b*. Further, the upper surface BP of each of the raised bottom portions 15 is positioned below the lower end E of the active electrode 12*b*, and an electrode material is not accumulated on the upper surface BP. Therefore, on the first end of each of the non-ejection grooves 6*b*, two active electrodes 12*b* that face each other inside the non-ejection groove 6*b* are prevented from being electrically connected to each other via the inclined surface 22. Similarly, on the second end of each of the non-ejection grooves 6*b*, two active electrodes 12*b* that face each other inside the non-ejection groove 6*b* are prevented from being electrically connected to each other via the upper surface BP of the raised bottom portion 15. Accordingly, the active electrodes 12*b* formed on the both side surfaces of each of the non-ejection grooves 6*b* are electrically separated from each other. Such electrode structures can be collectively formed by oblique deposition which will be described below. Therefore, the manufacturing process steps are extremely simplified.

The cover plate 3 is provided with a liquid discharge chamber 10 at the first side of the actuator substrate 2 and a liquid supply chamber 9 at the second side thereof. The cover plate 3 is adhered to the upper surface US of the actuator substrate 2 with adhesive so that a part of each of the ejection grooves 6*a* is covered, and the common terminals 16*a* and the active terminals 16*b* are exposed. The liquid supply chamber 9 communicates with the second ends of the ejection grooves 6*a* via the second slits 14*b*, and does not communicate with the non-ejection grooves 6*b*. The liquid discharge chamber 10 communicates with the first ends of the ejection grooves 6*a* via the first slits 14*a*, and does not communicate with the non-ejection grooves 6*b*. That is, the upper surface openings 7 of the non-ejection grooves 6*b* are covered with the cover plate 3. The nozzle plate 4 is adhered to the lower surface LS of the actuator substrate 2 with adhesive. Each of the nozzles 11 is positioned on substantially the center of the nozzle plate 4 in the longitudinal direction of the ejection grooves 6*a*. Liquid supplied to the liquid supply chamber 9 flows into the ejection grooves 6*a* via the second slits 14*b*, and is discharged into the liquid discharge chamber 10 via the first slits 14*a*. On the other hand, since the non-ejection grooves 6*b* do not communicate with the liquid supply chamber 9 or the liquid discharge chamber 10, liquid does not flow into the non-ejection grooves 6*b*. The nozzle plate 4 has a lower stiffness than the cover plate 3.

As the actuator substrate 2, a piezoelectric material, for example, PZT ceramics to which a polarization treatment is applied in a direction perpendicular to the upper surface US thereof can be used. The thickness of the actuator substrate 2 is, for example, in the range of 300 μm to 400 μm, and preferably 360 μm. The thickness of the raised bottom portions 15, formed on the respective non-ejection grooves 6*b*, between the upper surfaces BP and the lower surface LS is in the range of 10 μm to 180 μm. When the raised bottom portions 15 are thicker than 180 μm, a conductive body is prone to be accumulated on the upper surfaces BP when performing oblique deposition. On the other hand, when the raised bottom portions 15 are thinner than 10 μm, the raised bottom portion 15 becomes easy to break when grinding the lower surface LS. As the cover plate 3, PZT ceramics which is the same material as the actuator substrate 2, machinable ceramics, other kinds of ceramics, and a low dielectric material such as glass can be used. When the same material as the actuator substrate 2 is used for the cover plate 3, thermal expansion can be made equal between the cover plate 3 and the actuator substrate 2 to prevent the occurrence of warpage or deformation caused by temperature variation.

As the nozzle plate 4, a polyimide film, a polypropylene film, other synthetic resin films, a metal film, and the like can be used. The thickness of the cover plate 3 is preferably in the range of 0.3 mm to 1.0 mm. The thickness of the nozzle plate 4 is preferably in the range of 0.01 mm to 0.1 mm. When the cover plate 3 is thinner than 0.3 mm, the strength thereof is reduced. On the other hand, when the cover plate 3 is thicker than 1.0 mm, it takes time for the processing of the liquid supply chamber 9 and the liquid discharge chamber 10, and the first slits 14*a* and the second slits 14*b*. In addition, the manufacturing cost increases due to the increased amount of materials. Further, when the nozzle plate 4 is thinner than 0.01 mm, the strength thereof is reduced. On the other hand, when the nozzle plate 4 is thicker than 0.1 mm, vibration is transmitted between nozzles that are adjacent to each other, and crosstalk is thereby likely to occur.

The Young's modulus of PZT ceramics is 58.48 GPa, and the Young's modulus of polyimide is 3.4 GPa. Therefore, when PZT ceramics is used as the cover plate 3, and a polyimide film is used as the nozzle plate 4, the cover plate 3 which covers the upper surface US of the actuator substrate 2 has a higher stiffness than the nozzle plate 4 which covers the lower surface LS of the actuator substrate 2. The material of the cover plate 3 preferably has a Young's modulus of not less than 40 GPa. The material of the nozzle plate 4 preferably has a Young's modulus in the range of 1.5 GPa to 30 GPa. When the nozzle plate 4 has a Young's modulus of less than 1.5 GPa, the nozzle plate 4 bruises easily when making contact with a recording medium, and the reliability thereof is therefore reduced. On the other hand, when the nozzle plate 4 has a Young's modulus of more than 30 GPa, vibration is transmitted between nozzles that are adjacent to each other, and crosstalk is thereby likely to occur.

The liquid jet head 1 operates in the following manner. Liquid is supplied to the liquid supply chamber 9, and discharged from the liquid discharge chamber 10 to be circulated. Further, a driving signal is applied to the common terminal 16*a* and the active terminal 16*b* to thereby cause thickness-shear deformation of the walls 5 that form the ejection groove 6*a*. At this time, the walls 5 are deformed into an inverted V-shape, or deformed into a dogleg shape. Accordingly, a pressure wave is generated in liquid inside the ejection groove 6*a*, and liquid droplets are thereby ejected from the nozzle 11 that communicates with the ejection groove 6*a*. In the present embodiment, since the active electrodes 12*b* formed on the side surfaces of the walls 5 that form the respective non-ejection grooves 6*b* are electrically separated from each other, each of the ejection grooves 6*a* can be independently driven. By independently driving each of the ejection grooves 6*a*, high-frequency driving can be advantageously performed. Further, protection films can be formed on inner walls with which liquid comes in contact.

In the actuator substrate 2, a piezoelectric body may be used in the walls 5, and an insulating body composed of a non-piezoelectric body may be used in the other regions, instead of the configuration in which the entire actuator substrate 2 is composed of a piezoelectric body. Further, in the present embodiment, the description has been made with regard to the example in which the raised bottom portions 15 are formed on the second ends of the non-ejection grooves 6*b*, and the active electrodes 12*b* are provided on the side surfaces of the non-ejection grooves 6*b* so as to extend up to the second-side peripheral end RE of the actuator substrate 2 at the positions above the upper surfaces BP of the raised bottom portions 15. However, the present invention is not limited to such a configuration. Wiring electrodes may be formed on the upper surface US along the non-ejection grooves 6*b* to thereby electrically connect the active electrodes 12*b* and the active terminals 16*b*. Further, the function of the liquid discharge chamber 10 and the function of the liquid supply chamber 9 may be reversed, that is, liquid may be supplied from the liquid discharge chamber 10 and discharged from the liquid supply chamber 9.

(Second Embodiment)

Figure 3:
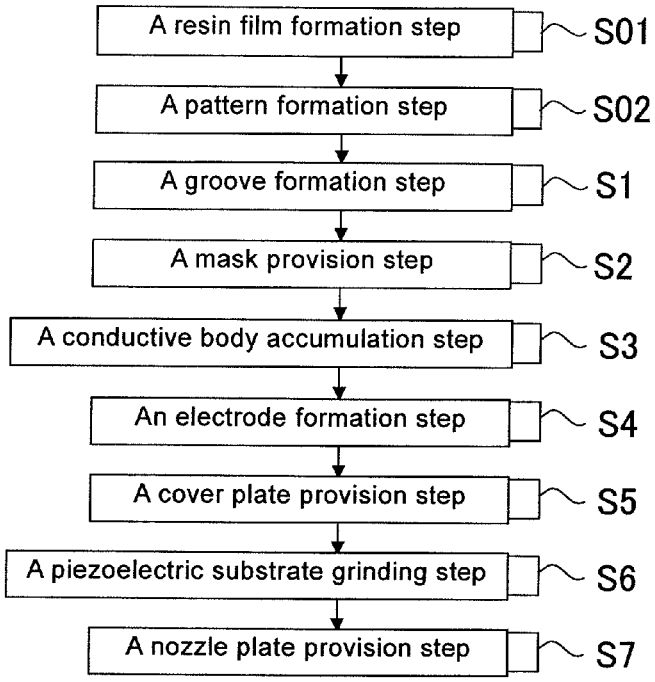
FIG. 3 is a flowchart of manufacturing process steps for a liquid jet head according to a second embodiment of the present invention.

FIGS. 3 to 11B are drawings for explaining a method of manufacturing a liquid jet head 1 according to the second embodiment of the present invention. FIG. 3 is a flowchart of manufacturing process steps for the liquid jet head 1 according to the second embodiment of the present invention. FIGS. 4A to 11B are explanatory drawings for the respective steps. Hereinbelow, the method of manufacturing the liquid jet head 1 will be described in detail with reference to FIGS. 3 to 11B. The same components or components having the same function are denoted by the same marks throughout the drawings.

Figure 4A:
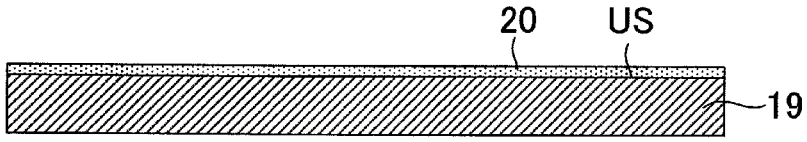
FIGS. 4A and 4B are explanatory drawings of the manufacturing process steps for the liquid jet head according to the second embodiment of the present invention.
Figure 4B:
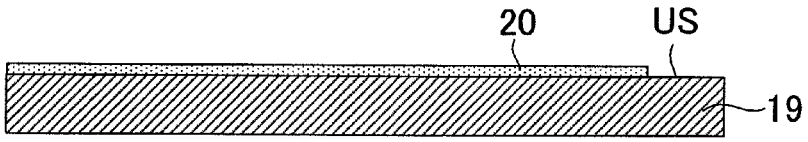

FIGS. 4A and 4B are cross-sectional schematic views of a piezoelectric substrate 19. As shown in FIG. 4A, in a resin film formation step S01, a photosensitive resin film 20 is formed on an upper surface US of the piezoelectric substrate 19. As the piezoelectric substrate 19, PZT ceramics can be used. A resist film can be applied onto the piezoelectric substrate 19 to form the resin film 20. Further, a photosensitive resin film can be arranged thereon. Next, as shown in FIG. 4B, in a pattern formation step S02, a pattern of the resin film 20 is formed by performing exposure and development. A part of the resin film 20 is removed in a region where electrodes are later formed, and the other part of the resin film 20 is left in a region where an electrode is not formed in order to pattern the electrodes by lift-off later.

Figure 5A:
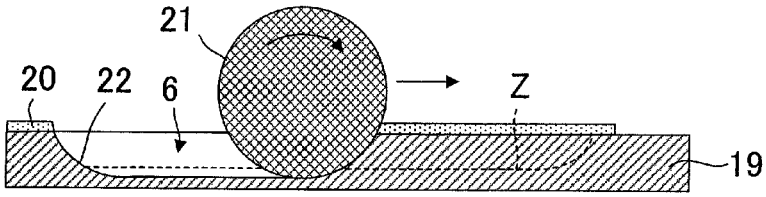
FIGS. 5A to 5D are explanatory drawings of the manufacturing process steps for the liquid jet head according to the second embodiment of the present invention.
Figure 5B:
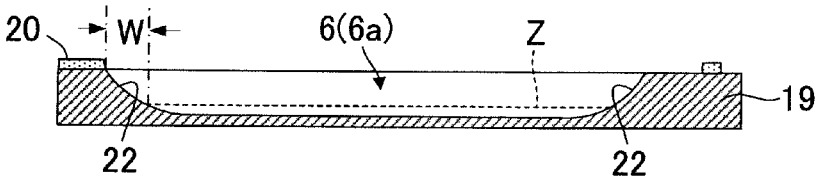
Figure 5C:
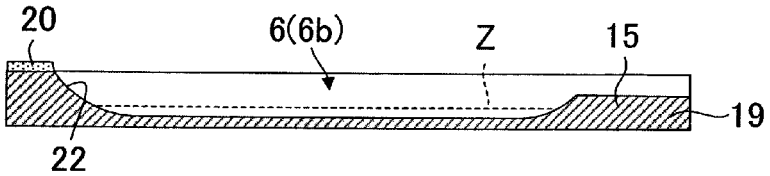
Figure 5D:
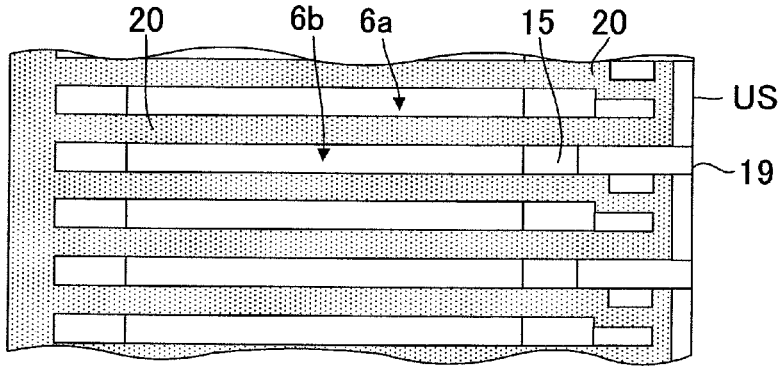

FIG. 5A is a cross-sectional schematic view illustrating a groove 6 being formed by grinding using a dicing blade 21. FIG. 5B is a cross-sectional schematic view of an ejection groove 6*a*. FIG. 5C is a cross-sectional schematic view of a non-ejection groove 6*b*. FIG. 5D is a schematic view of an upper surface of the piezoelectric substrate 19 on which the grooves 6 are formed. As shown in FIGS. 5A to 5D, in a groove formation step S1, a plurality of parallel grooves 6 is formed in the piezoelectric substrate 19. The grooves 6 include the ejection grooves 6*a* and the non-ejection grooves 6*b*. The ejection grooves 6*a* and the non-ejection grooves 6*b* are alternately formed in parallel. The dicing blade 21 is moved downward onto one end (first end) of the groove 6, then horizontally moved toward the other end (second end) thereof, and then moved upward therefrom. The piezoelectric substrate 19 is ground with the dicing blade 21 up to a depth not to reach the lower surface thereof as well as deeper than the depth of the ejection grooves 6*a* and the non-ejection grooves 6*b* indicated by broken line Z. Further, in each of the non-ejection grooves 6*b*, the second end thereof is ground shallowly up to the peripheral end of the piezoelectric substrate 19 to form a raised bottom portion 15.

By grinding the piezoelectric substrate 19 up to the depth deeper than the final depth of the ejection grooves 6*a* and the non-ejection grooves 6*b* indicated by broken line Z, a width W of inclined surfaces 22 in the longitudinal direction thereof can be reduced. More specifically, since the piezoelectric substrate 19 is ground using the dicing blade 21, the outer peripheral shape of the dicing blade 21 is transferred onto the first ends of the ejection grooves 6*a*, the second ends of the ejection grooves 6*a*, and the first ends of the non-ejection grooves 6*b*. For example, when forming a groove having a depth of 360 μm using the dicing blade 21 of two inches, the width of the inclined surface 22 at an end of the groove in the longitudinal direction thereof becomes approximately 4 mm. On the other hand, when forming a groove having a depth of 590 μm using the dicing blade 21, the width W up to the depth of 360 μm can be reduced to approximately 2 mm, namely, half the width in the above case. Such reduction of the width W can be made on two places, namely, the first end and the second end of the groove. That is, 4 mm in total can be reduced. As a result, it is possible to increase the number of piezoelectric substrates 19 that can be taken from a single piezoelectric wafer.

Figure 6A:
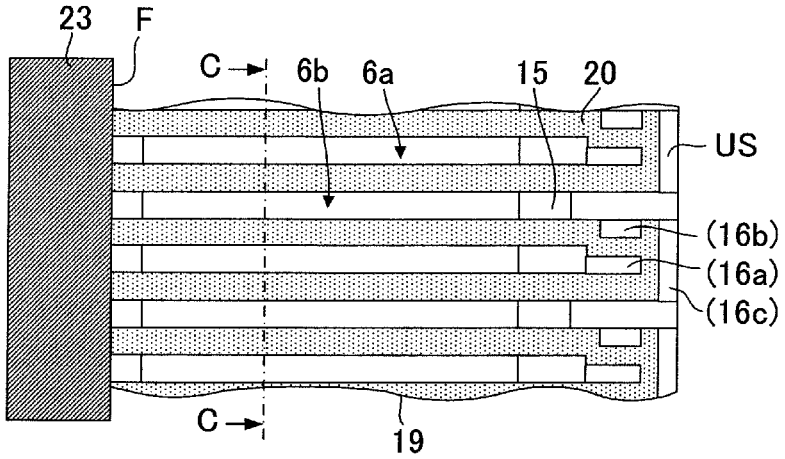
FIGS. 6A and 6B are explanatory drawings of the manufacturing process steps for the liquid jet head according to the second embodiment of the present invention.
Figure 6B:
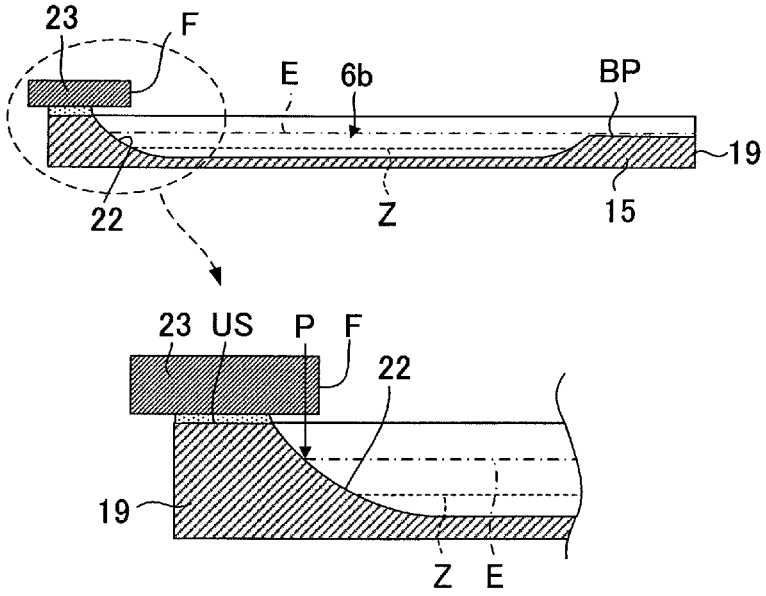

FIGS. 6A and 6B are drawings for explaining a state where a mask 23 is provided on an end of the piezoelectric substrate 19 positioned at the first side (first end). FIG. 6A is a schematic view of the upper surface of the piezoelectric substrate 19. FIG. 6B is a cross-sectional schematic view of the non-ejection groove 6*b* along the longitudinal direction thereof. As shown in FIGS. 6A and 6B, in a mask provision step S2, the mask 23 is provided on the piezoelectric substrate 19 so as to cover the first ends of the grooves 6. In the mask 23, an end F thereof positioned at the second side is located closer to the second side from a point P on the inclined surface 22 at the same depth as a lower end E of an active electrode 12*b*. Further, the mask 23 is provided at a position in which first slits communicating with the respective ejection grooves 6*a* are opened toward the ejection grooves 6*a*. In other words, the mask 23 covers a part of each of the inclined surfaces 22 formed on the first side, the part being shallower than the depth of the lower end E of each of the active electrodes, and a part of the upper surface US of the piezoelectric substrate 19 on the first end thereof. In addition, an end of a common electrode at the first side is positioned within a region in which a first slit is opened toward the ejection groove.

Figure 7:
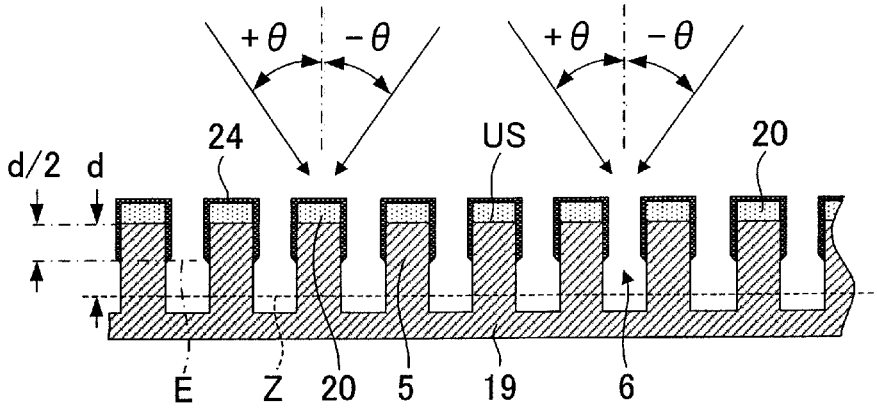
FIG. 7 is an explanatory drawing of the manufacturing process steps for the liquid jet head according to the second embodiment of the present invention.

FIG. 7 is a view of a conductive body 24 accumulated by oblique deposition. FIG. 7 is a cross-sectional schematic view taken along line C-C of FIG. 6A. In a conductive body accumulation step S3, the conductive body 24 is deposited on the upper surface US of the piezoelectric substrate 19 by oblique deposition from angles +θ and −θ, each of which is inclined, relative to the normal line of the upper surface US, toward a direction perpendicular to the longitudinal direction of each of the grooves 6. In the present embodiment, the conductive body 24 is accumulated up to a depth that is approximately half a depth d between the upper surfaces US of the respective walls 5 and broken line Z, that is, up to a depth d/2. In the inclined surface 22 formed on the first end of each of the non-ejection grooves 6*b*, at least a part of the inclined surface 22 shallower than the depth d/2 is covered with the mask 23. Therefore, the conductive body 24 is not accumulated on this shallow part of the inclined surface 22. Further, since the upper surface BP of each of the raised bottom portions 15 is positioned below the lower end E (see FIG. 6B), the conductive body 24 is not accumulated on the upper surface BP. On the other hand, in an inclined surface 22 formed on the second end of each of the ejection grooves 6*a*, the conductive body 24 is accumulated on a part of the inclined surface 22 shallower than the depth d/2, in the same manner as in the upper surface US of the piezoelectric substrate 19. The conductive body 24 may be formed so as to be shallower than the final depth of the grooves 6 indicated by broken line Z as well as deeper than the depth d/2.

Figure 8:
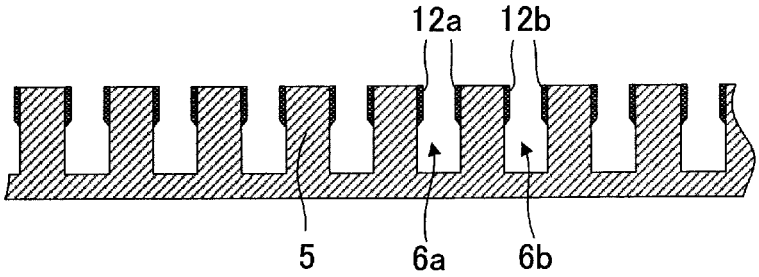
FIG. 8 is an explanatory drawing of the manufacturing process steps for the liquid jet head according to the second embodiment of the present invention.

FIG. 8 is a view illustrating a state where the resin film 20 is removed and, at the same time, a part of the conductive body 24 on the resin film 20 is removed. In an electrode formation step S4, the conductive body 24 is patterned to form the common electrodes 12*a* and the active electrodes 12*b*. Specifically, the part of the conductive body 24 accumulated on the resin film 20 is removed by lift-off for removing the resin film 20. Accordingly, the conductive body 24 accumulated on both side surfaces of the respective walls 5 is divided, and the common electrodes 12*a* and the active electrodes 12*b* are thereby formed. In the electrode formation step S4, common terminals 16*a*, active terminals 16*b*, and wirings 16*c* are also formed at the same time (see FIG. 6A). Accordingly, the active electrodes 12*b* formed on the both side surfaces of each of the non-ejection grooves 6*b* are electrically separated from each other, and the common electrodes 12*a* formed on the both side surfaces of the respective ejection grooves 6*a* are electrically connected to each other. Further, the common electrodes 12*a* are electrically connected to the respective common terminals 16*a*, and the active electrodes 12*b* are electrically connected to the respective active terminals 16*b* (see FIG. 6A). Each of the active terminals 16*b* is electrically connected to an active electrode 12*b* that is formed on the side surface of one of two walls 5 that sandwich an ejection groove 6*a* therebetween, the side surface facing a non-ejection groove 6*b*. Further, the active terminal 16*b* is electrically connected to an active electrode 12*b* that is formed on the side surface of the other one of the two walls 5, the surface facing a non-ejection groove 6*b*, via a wiring 16*c* formed along the second-side peripheral end RE.

In the present embodiment, the lower end E of each of the common electrodes 12*a* and the active electrodes 12*b* formed by oblique deposition is positioned at the depth approximately half the final depth d of the ejection grooves 6*a* and the non-ejection grooves 6*b*. However, the common electrodes 12*a* and the active electrodes 12*b* may be formed at deeper positions. Also in such a case, the common electrodes 12*a* and the active electrodes 12*b* are formed so as not to reach the final depth of the ejection grooves 6*a* and the non-ejection grooves 6*b* indicated by broken line Z. By forming the common electrodes 12*a* and the active electrodes 12*b* so as to be separated from the bottom surfaces of the ejection grooves 6*a* and the non-ejection grooves 6*b* indicated by broken line Z, liquid droplets can be stably ejected.

Figure 9A:
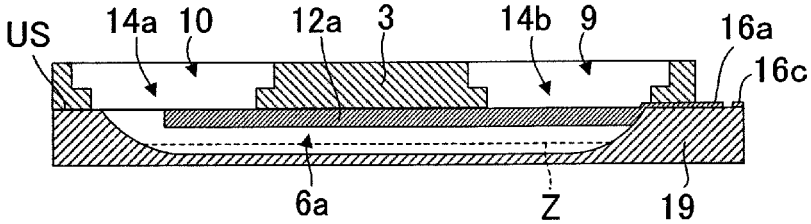
FIGS. 9A and 9B are explanatory drawings of the manufacturing process steps for the liquid jet head according to the second embodiment of the present invention.
Figure 9B:
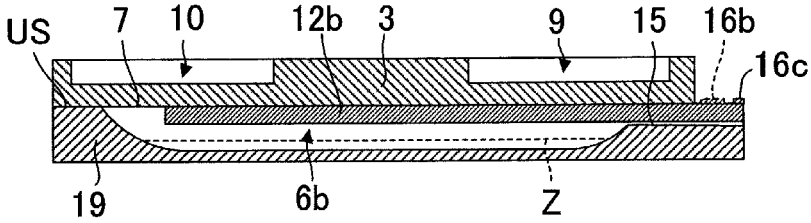

FIGS. 9A and 9B are cross-sectional schematic views illustrating the cover plate 3 provided on the upper side of the piezoelectric substrate 19. FIG. 9A is a cross-sectional schematic view of the ejection groove 6*a* in the longitudinal direction thereof. FIG. 9B is a cross-sectional schematic view of the non-ejection groove 6*b* in the longitudinal direction thereof. As shown in FIGS. 9A and 9B, in a cover plate provision step S5, the cover plate 3 is provided on the upper side of the piezoelectric substrate 19. The cover plate 3 is provided with a liquid discharge chamber 10 formed on one side (first side) and a liquid supply chamber 9 formed on the other side (second side) thereof. Further, the cover plate 3 includes first slits 14*a* which penetrate the cover plate 3 from the liquid discharge chamber 10 through a back surface of the cover plate 3 on the opposite side of the liquid discharge chamber 10, and second slits 14*b* which penetrate the cover plate 3 from the liquid supply chamber 9 through the back surface of the cover plate 3 on the opposite side of the liquid supply chamber 9. The liquid discharge chamber 10 communicates with the first ends of the ejection grooves 6*a* via the first slits 14*a*. The liquid supply chamber 9 communicates with the second ends of the ejection grooves 6*a* via the second slits 14*b*. The upper surface openings 7 of the non-ejection grooves 6*b* are closed by the cover plate 3. Therefore, the non-ejection grooves 6*b* do not communicate with the liquid discharge chamber 10 or the liquid supply chamber 9.

Figure 10A:
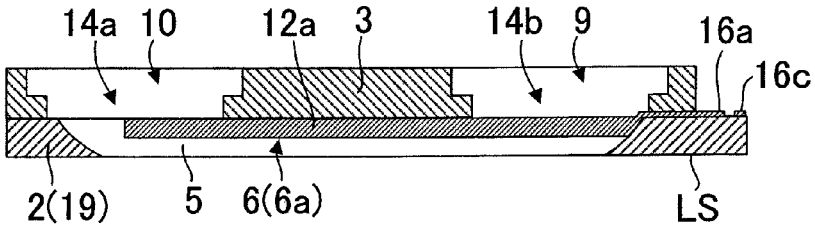
FIGS. 10A and 10B are explanatory drawings of the manufacturing process steps for the liquid jet head according to the second embodiment of the present invention.
Figure 10B:
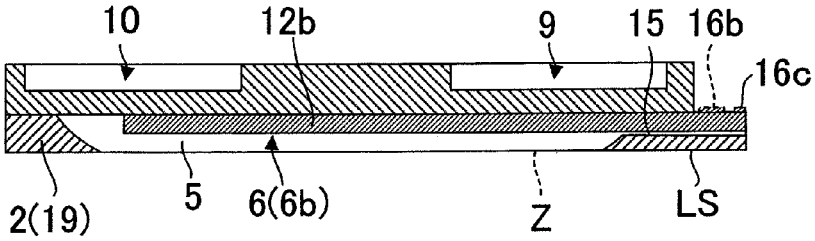

FIGS. 10A and 10B are cross-sectional schematic views illustrating a state where a back surface of the piezoelectric substrate 19 is ground, the back surface being positioned at the opposite side of the cover plate 3. FIG. 10A is a cross-sectional schematic view of the ejection groove 6*a* in the longitudinal direction thereof. FIG. 10B is a cross-sectional schematic view of the non-ejection groove 6*b* in the longitudinal direction thereof. As shown in FIGS. 10A and 10B, in a piezoelectric substrate grinding step S6, the piezoelectric substrate 19 is ground from the back surface thereof that is opposite to the surface on which the grooves 6 are formed to thereby form an actuator substrate 2 by allowing the grooves 6 to penetrate the actuator substrate 2 from the upper surface US through the lower surface LS thereof. The back surface of the piezoelectric substrate 19 is ground up to the final depth of the grooves 6 indicated by broken line Z. The upper surfaces US of the respective walls 5 are fixed by the cover plate 3. Further, the piezoelectric substrate 19 is left on the first ends of the grooves 6, and the second ends thereof including the raised bottom portions 15. Therefore, breakage during the grinding can be prevented.

Figure 11A:
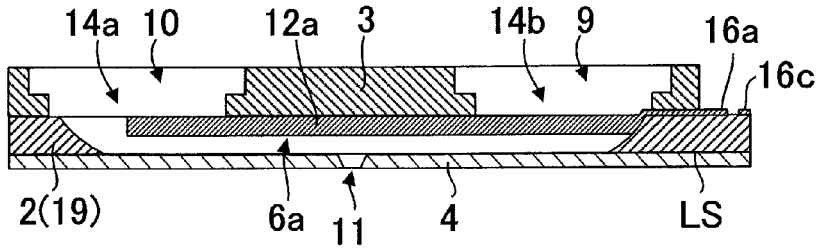
FIGS. 11A and 11B are explanatory drawings of the manufacturing process steps for the liquid jet head according to the second embodiment of the present invention.
Figure 11B:
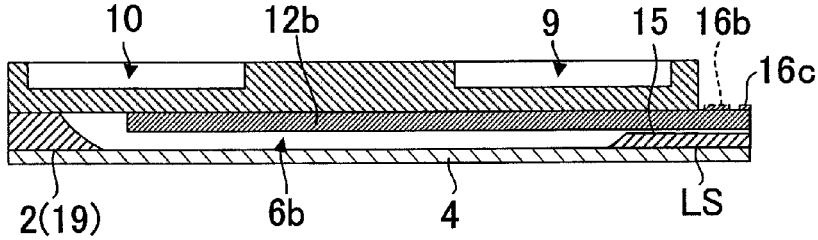

FIGS. 11A and 11B are views of the nozzle plate 4 adhered to the lower surface LS of the actuator substrate 2 (piezoelectric substrate 19). FIG. 11A is a cross-sectional schematic view of the ejection groove 6*a* in the longitudinal direction thereof. FIG. 11B is a cross-sectional schematic view of the non-ejection groove 6*b* in the longitudinal direction thereof. As shown in FIGS. 11A and 11B, in a nozzle plate provision step S7, the nozzle plate 4 is provided on the lower surface LS of the piezoelectric substrate 19. Nozzles 11 are opened on the nozzle plate 4, and communicate with the respective ejection grooves 6*a*. The nozzle plate 4 has a lower stiffness than the cover plate 3.

This manufacturing method makes it possible to electrically separate the active electrodes 12*b* formed on the both side surfaces of the respective non-ejection grooves 6*b* in a single process. Therefore, it is not necessary to divide the conductive body 24 formed on the upper surfaces of the respective walls 5 one by one, and the manufacturing method is therefore extremely simplified. Further, since the inclined surface 22 formed on the end of each of the grooves 6 can be formed to have a narrow width, it is possible to increase the number of piezoelectric substrates 19 that can be taken from a single piezoelectric wafer. As a result, the manufacturing cost can be reduced.

In the piezoelectric substrate 19, a piezoelectric body may be used at least in the walls 5 which partition the respective grooves 6, and the other region may be an insulating body composed of a non-piezoelectric body. Further, as described in the first embodiment, the non-ejection grooves 6*b* (or also the ejection grooves 6*a*) can be formed so that the material of the actuator substrate 2 is left on the bottoms thereof. The nozzle plate 4 is not necessarily a single layer, and can therefore include a plurality of thin film layers of different materials. In the present embodiment, the patterning of the common electrodes 12*a*, the active electrodes 12*b*, the common terminals 16*a*, and the active terminals 16*b* are performed by lift-off. However, the present invention is not limited thereto. For example, the patterns of the common electrodes 12*a*, the active electrodes 12*b*, the common terminals 16*a*, and the active terminals 16*b* may also be formed by photolithography and etching after the conductive body 24 is formed on the upper surface US of the piezoelectric substrate 19 and the side surfaces of the walls 5 by oblique deposition in the conductive body accumulation step S3 (FIG. 7). Further, the piezoelectric substrate grinding step S6 can be omitted. Specifically, the grooves 6 may be formed in the following manner. The thickness of the piezoelectric substrate 19 is set to be approximately the same as the final depth of the grooves 6. Further, in the groove formation step S1 shown in FIGS. 5A to 5D, the piezoelectric substrate 19 is deeply ground with the dicing blade 21 so that the dicing blade 21 penetrates the lower surface of the piezoelectric substrate 19 to form the lower surface openings 8 thereon, and, at the same time, the raised bottom portions 15 are left on the piezoelectric substrate 19.

(Third Embodiment)

Figure 12:
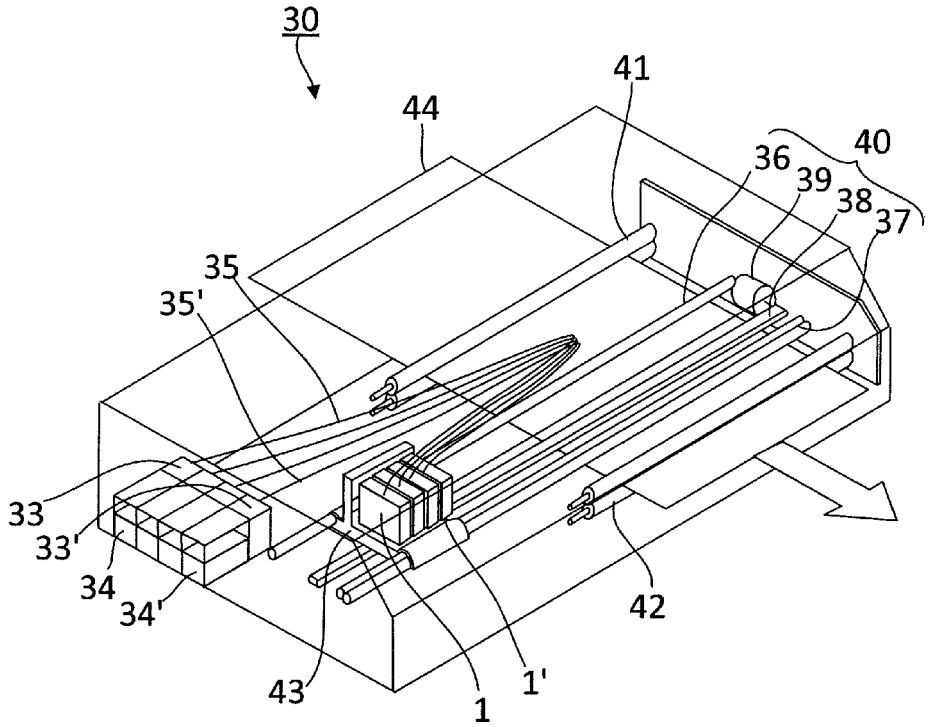
FIG. 12 is a schematic perspective view of a liquid jet apparatus according to a third embodiment of the present invention.
Figure 13A:
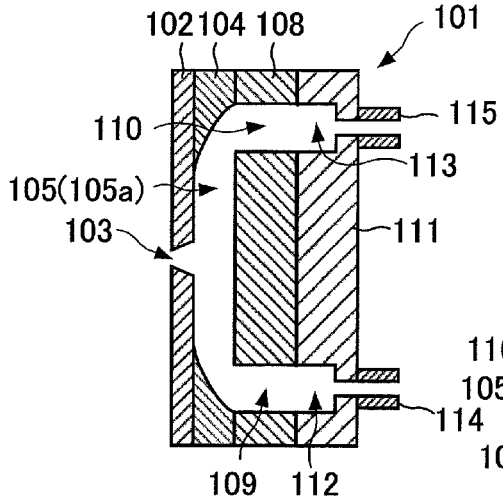
Fig.13A Prior art
FIGS. 13A and 13B are cross-sectional schematic views of a conventionally-known liquid jet head.
Figure 13B:
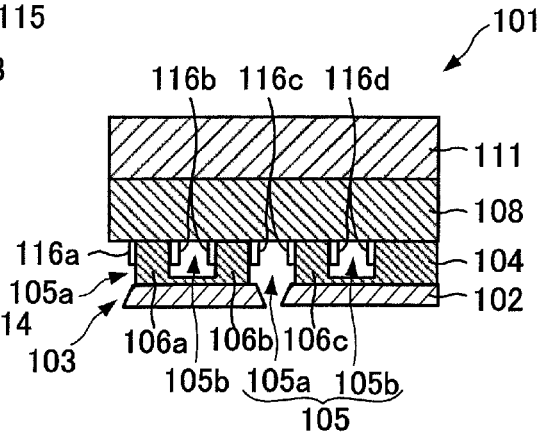
Fig.13B Prior art
Figure 14:
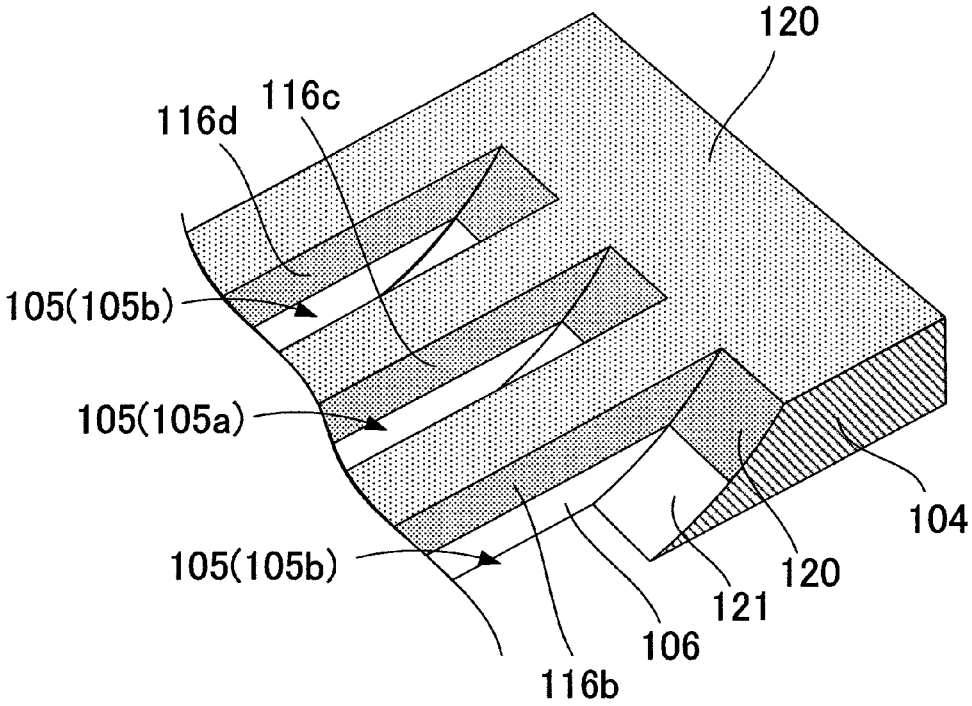
Fig.14 Prior art
FIG. 14 is a fragmentary perspective view of a piezoelectric plate of the conventionally-known liquid jet head.

FIG. 12 is a schematic perspective view of a liquid jet apparatus 30 according to the third embodiment of the present invention. The liquid jet apparatus 30 is provided with a movement mechanism 40 which reciprocates liquid jet heads 1 and 1', flow path sections 35 and 35' which respectively supply liquid to the liquid jet heads 1 and 1' and discharge liquid from the liquid jet heads 1 and 1', and liquid pumps 33 and 33' and liquid tanks 34 and 34' which respectively communicate with the flow path sections 35 and 35'. Each of the liquid jet heads 1 and 1' is provided with a plurality of head chips, and each of the head chips is provide with a plurality of channels of ejection grooves. Each of the liquid jet heads 1 and 1' ejects liquid droplets from nozzles that communicate with the respective channels. As the liquid pumps 33 and 33', either or both of supply pumps which supply liquid to the flow path sections 35 and 35' and discharge pumps which discharge liquid to components other than the flow path sections 35 and 35' are provided. Further, a pressure sensor or a flow sensor (not shown) may be provided to control the flow rate of liquid. As each of the liquid jet heads 1 and 1', the liquid jet head of the first embodiment described above is used.

The liquid jet apparatus 30 is provided with a pair of conveyance units 41 and 42 which conveys a recording medium 44 such as paper in a main scanning direction, the liquid jet heads 1 and 1' each of which ejects liquid onto the recording medium 44, a carriage unit 43 on which the liquid jet heads 1 and 1' are loaded, the liquid pumps 33 and 33' which respectively supply liquid stored in the liquid tanks 34 and 34' to the flow path sections 35 and 35' by pressing, and the movement mechanism 40 which moves the liquid jet heads 1 and 1' in a sub-scanning direction that is perpendicular to the main scanning direction. A control unit (not shown) controls the liquid jet heads 1 and 1', the movement mechanism 40, and the conveyance units 41 and 42 to drive.

Each of the pair of conveyance units 41 and 42 extends in the sub-scanning direction, and includes a grid roller and a pinch roller which rotate with the roller surfaces thereof making contact with each other. The grid roller and the pinch roller are rotated around the respective shafts by a motor (not illustrated) to thereby convey the recording medium 44, which is sandwiched between the rollers, in the main scanning direction. The movement mechanism 40 is provided with a pair of guide rails 36 and 37 each of which extends in the sub-scanning direction, the carriage unit 43 which can slide along the pair of guide rails 36 and 37, an endless belt 38 to which the carriage unit 43 is coupled to move the carriage unit 43 in the sub-scanning direction, and a motor 39 which revolves the endless belt 38 via a pulley (not illustrated).

The carriage unit 43 loads the plurality of liquid jet heads 1 and 1' thereon. The liquid jet heads 1 and 1' eject, for example, liquid droplets of four colors including yellow, magenta, cyan, and black. Each of the liquid tanks 34 and 34' stores liquid of corresponding color, and supplies the stored liquid to each of the liquid jet heads 1 and 1' through each of the liquid pumps 33 and 33' and each of the flow path sections 35 and 35'. Each of the liquid jet heads 1 and 1' ejects liquid droplets of corresponding color in response to a driving signal. Any patterns can be recorded on the recording medium 44 by controlling the timing of ejecting liquid from the liquid jet heads 1 and 1', the rotation of the motor 39 for driving the carriage unit 43, and the conveyance speed of the recording medium 44.

In the liquid jet apparatus 30 of the present embodiment, the movement mechanism 40 moves the carriage unit 43 and the recording medium 44 to perform recording. Alternatively, however, the liquid jet apparatus may have a configuration in which a carriage unit is fixed, and a movement mechanism two-dimensionally moves a recording medium to perform recording. That is, the movement mechanism may have any configuration as long as it can relatively move a liquid jet head and a recording medium.

What is claimed is:

1. A liquid jet head comprising:

an actuator substrate partitioned by elongated walls of a piezoelectric body, the actuator substrate having elongated ejection grooves and elongated non-ejection grooves separated from one another by the walls and alternately arrayed on the actuator substrate so as to penetrate the actuator substrate from an upper surface through a lower surface thereof, wherein the non-ejection grooves extend from the vicinity of a first-side peripheral end of the actuator substrate positioned at a first side of the liquid jet head up to a second-side peripheral end thereof positioned at a second side of the liquid jet head, and the actuator substrate has raised bottom portions that define the bottoms of the non-ejection grooves near the second-side peripheral end of the actuator substrate.

2. The liquid jet head according to claim 1, wherein common electrodes are formed in strip form on side surfaces of the walls, the side surfaces facing the ejection grooves, along a longitudinal direction of the walls, and active electrodes are formed in strip form on side surfaces of the walls, the side surfaces facing the non-ejection grooves, along the longitudinal direction of the walls, and the active electrodes are arranged above upper surfaces of the raised bottom portions.

3. The liquid jet head according to claim 2, wherein each of the active electrodes is formed from a position in the vicinity of a first end of each of the non-ejection grooves, the first end being positioned at the first side, up to the second-side peripheral end of the actuator substrate.

4. The liquid jet head according to claim 2, wherein each of the non-ejection grooves includes, on the first end thereof, an inclined surface inclined outward from a lower surface opening opened on a lower surface of the non-ejection groove toward an upper surface opening opened on an upper surface thereof, and an end of each of the active electrodes, the end being positioned at the first side, is located closer to the second side from a point on the inclined surface at the same depth as a lower end of the active electrode.

5. The liquid jet head according to claim 1, further comprising:

a cover plate provided on the upper surface of the actuator substrate, the cover plate having first slits communicating with the ejection grooves on the first side and second slits communicating with the ejection grooves on the second side; and a nozzle plate provided on the lower surface of the actuator substrate and having nozzles communicating with the ejection grooves.

6. The liquid jet head according to claim 5, wherein each of the common electrodes is arranged in each of the ejection grooves from a position at which each of the first slits is opened up to an end thereof positioned at the second side.

7. The liquid jet head according to claim 6, wherein a material of the nozzle plate has a lower stiffness than a material of the cover plate.

8. The liquid jet head according to claim 1, wherein the upper surfaces of the raised bottom portions are located at positions deeper than approximately half the depth of the ejection grooves.

9. A liquid jet apparatus comprising:

the liquid jet head according to claim 1;

a movement mechanism configured to relatively move the liquid jet head and a recording medium;

a liquid supply tube configured to supply liquid to the liquid jet head; and a liquid tank configured to supply the liquid to the liquid supply tube.

10. A method of manufacturing a liquid jet head, comprising:

a groove formation step of forming ejection grooves and non-ejection grooves on a piezoelectric substrate so as to be alternately arrayed in parallel, wherein an end portion of each of the non-ejection grooves, the end portion being positioned at one side of the piezoelectric substrate, is ground shallowly to form a raised bottom portion of the non-ejection groove;

a mask provision step of providing a mask so as to cover an end of each of the ejection grooves, the end being positioned at the other side of the piezoelectric substrate, and an end of each of the non-ejection grooves, the end being positioned at the other side of the piezoelectric substrate;

a conductive body accumulation step of accumulating a conductive body on the piezoelectric substrate by oblique deposition;

an electrode formation step of forming electrodes by patterning the conductive body;

a cover plate provision step of providing a cover plate on an upper side of the piezoelectric substrate; and a nozzle plate provision step of providing a nozzle pate on a lower side of the piezoelectric substrate.

11. The method of manufacturing a liquid jet head according to claim 10, further comprising, after the groove formation step:

a piezoelectric substrate grinding step of grinding a lower surface of the piezoelectric substrate, the lower surface being opposite to an upper surface on which the ejection grooves and the non-ejection grooves are formed, to allow the non-ejection grooves to penetrate the piezoelectric substrate from the upper surface through the lower surface thereof.

12. The method of manufacturing a liquid jet head according to claim 11, wherein the nozzle plate provision step includes providing the nozzle plate on the lower surface of the piezoelectric substrate.

* * * * *